US005228683A

United States Patent [19]

Beimel

[11] Patent Number: 5,228,683

[45] Date of Patent: Jul. 20, 1993

[54] BASEBALL BATTERS TRAINING DEVICE

[76] Inventor: Roger G. Beimel, 151 Bimol Ln. Box 57, Kersey, Pa. 15846

[21] Appl. No.: 871,002

[22] Filed: Apr. 20, 1992

[51] Int. Cl.[5] ..... A63B 69/40

[52] U.S. Cl. ..... 273/26 R; 273/29 A

[58] Field of Search ..... 273/29 A, 26 R, 29 R

[56] References Cited

U.S. PATENT DOCUMENTS

| | | | |
|---|---|---|---|
| 1,973,424 | 9/1934 | Albera | 273/26 R |
| 3,762,705 | 10/1973 | Gonzalez | 273/26 R |
| 3,937,464 | 2/1976 | Zalewski | 273/26 R |
| 4,655,452 | 4/1987 | Huerstel | 273/26 R |
| 4,907,801 | 3/1990 | Kopp | 273/26 R |

FOREIGN PATENT DOCUMENTS

| | | | |
|---|---|---|---|
| 7905283 | 1/1981 | France | 273/29 A |
| 2591906 | 6/1987 | France | 273/29 A |
| 2600899 | 1/1988 | France | 273/29 A |

*Primary Examiner*—Theatrice Brown
*Attorney, Agent, or Firm*—Karl Geci

[57] ABSTRACT

The invention relates to a baseball batting practice device having a support frame and a frame member mounted on the support frame. An electrical power source is provided for randomly starting and stopping the frame member during upward and downward movement in a strike zone on the support frame. A flexible ball support arm having one of its ends mounted on the frame member and having a ball attached to its other end, such that the arm and ball will rotate in a vertical plane when the ball is struck by a batter. A control box having an on-off switch for a light and a device for computing the time of a batter's swing from the time the light comes on and the time the ball is struck by a bat.

3 Claims, 4 Drawing Sheets

BASEBALL BATTERS TRAINING DEVICE

FIELD OF THE INVENTION

The invention is an electromechanical device for improving a batters' skills, timing, hand/eye coordination, and general batter improvement having a frame, electronic controls for a timer, time readout, pitched ball light, a drive motor, a power source, and a pivot arm with attached impact cushion "ball".

BACKGROUND OF THE INVENTION

Baseball has long been one of America's most favorite of past-times and a high batting average has long been the standard by which baseball players are measured. The purpose underlying this invention is to improve the hitting ability and thereby improve batting averages for baseball players of all ages from the pee-wee leagues to the major leagues. Devices that are known to train batters include pitching machines and tee-ball stands. In each case a ball is struck and retrieval of the ball is necessary. Utilizing my invention, a batter improves his hitting ability by taking a regular baseball bat in hand, taking his or her favorite baseball stance, activating the machine, watching for the pitching light, activated randomly, to come on as the ball travels up or down through the strike zone thereby telling the batter to strike at the ball. The batters swing contacting the ball is recorded by a digital readout to the nearest one-thousandth of a second. Upon completion of the swing, the next sequence begins with the ball again randomly moving through the strike zone until the electronic pitching light again activates alerting the batter to take another home-run swing. The time between swings is random and may range between two seconds and eight seconds from time impact arm assembly starts moving. My batting machine is entirely suited for indoor or outdoor use; does not require ball retrieval to begin a new practice cycle; requires only limited space; has automatic repositioning of the ball for subsequent swings; measures and digitally reads out batter reaction time; greatly improves bat accuracy, power and bat velocity all of which greatly improve overall batting skills.

BRIEF DESCRIPTION OF THE DRAWINGS

The invention will be explained in more detail here and under with reference to several exemplary embodiments which are shown in the drawings. In the drawings.

DETAILED DESCRIPTION OF THE DRAWINGS

Figure 1:
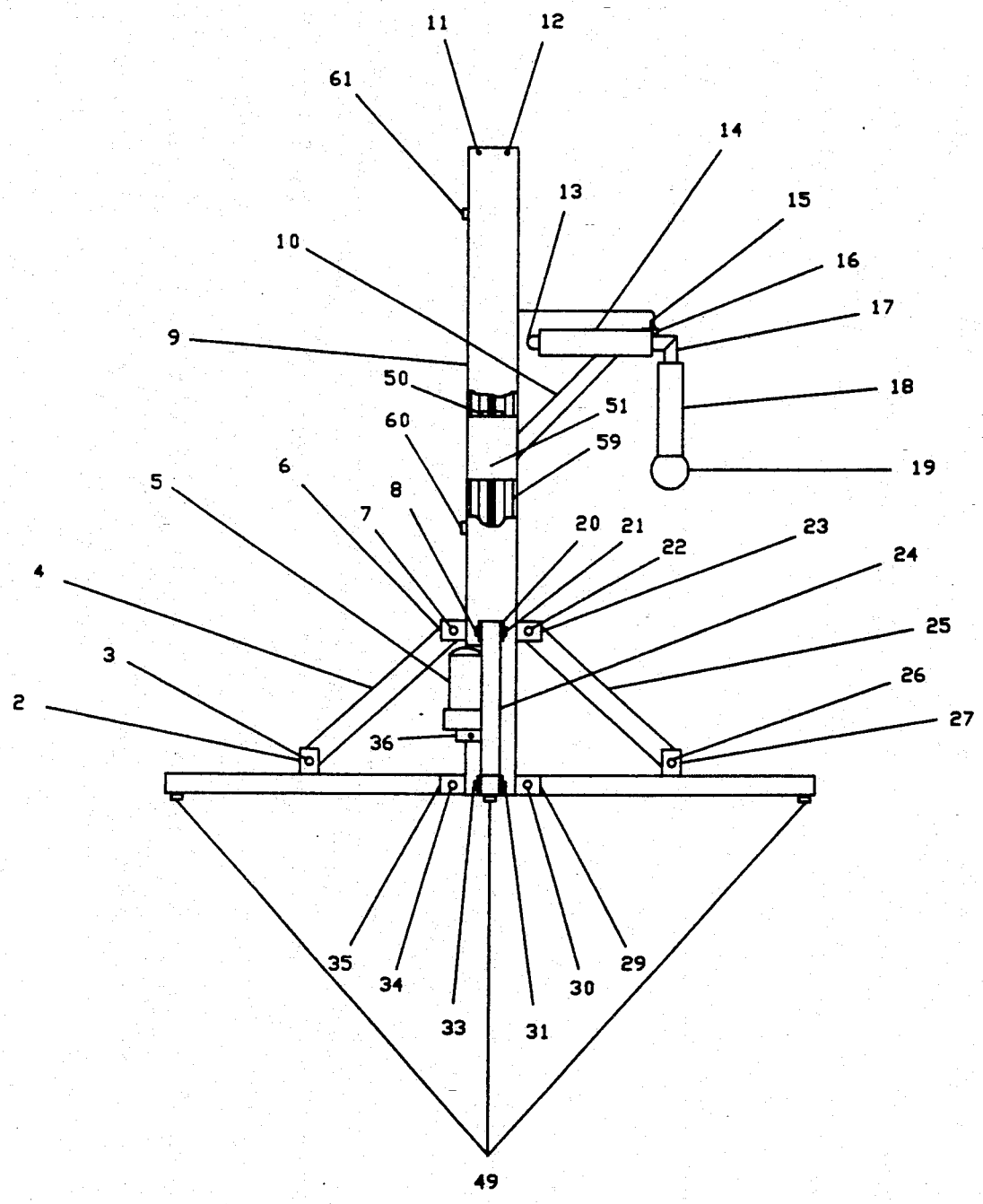
FIG. 1 shows a side view of a device embodying the invention.
Figure 4:
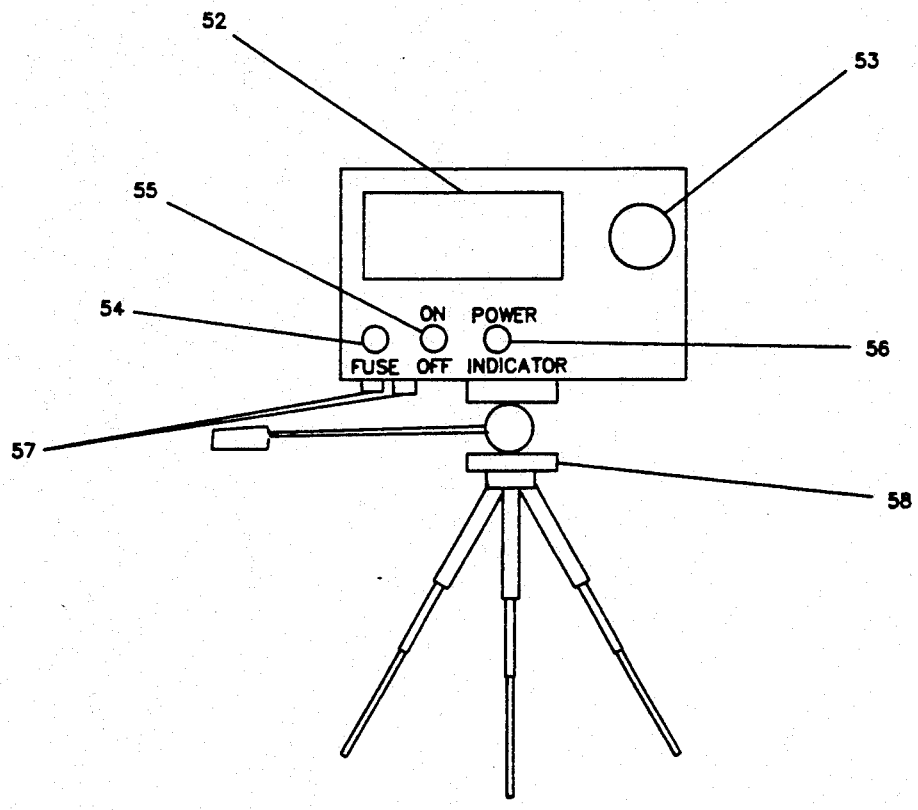
FIG. 4 shows a front view of the electronic controls as mounted on a tripod.

The batting machine device as shown in FIG. 1 has a frame leg braces 4, 24, and 25; an impact arm support 10; a rotary arm housing 14; an electrical switch 16 wired to the electronic timer in the control box, shown in FIG. 4, which, when tripped by rotation of the arm 17, completes the circuit for calculating the time required for the batter's swing; a rotary arm 17; a flexible impact arm 18; a servo with gear box 5; pedestal leveling feet 49; a slide housing 51; a leg brace bracket 2, 6, 20, 23, 27, and 31; nut and bolt 3, 7, 22, 26, 30, 33, 34;

bolt 8, 11, 12; a rotary arm endcap 13; a bracket 15; an impact ball 19; a nut 21; leg brackets 29, 35; a servo support bracket 36; a lead screw nut 50; slide rails 59; limiting switches 60 and 61. The design of my machine as shown in FIG. 1 is such that the ball 19 is mounted on a flexible impact arm 18 which itself is rotatably connected to the impact arm support 10. As the impact ball is struck, the ball and flexible impact arm rotate freely about its axis for a few seconds until its energy has dissipated and it is ready to be struck again. The ball and flexible impact arm then returns automatically to its original position ready to be struck again.

Figure 2:
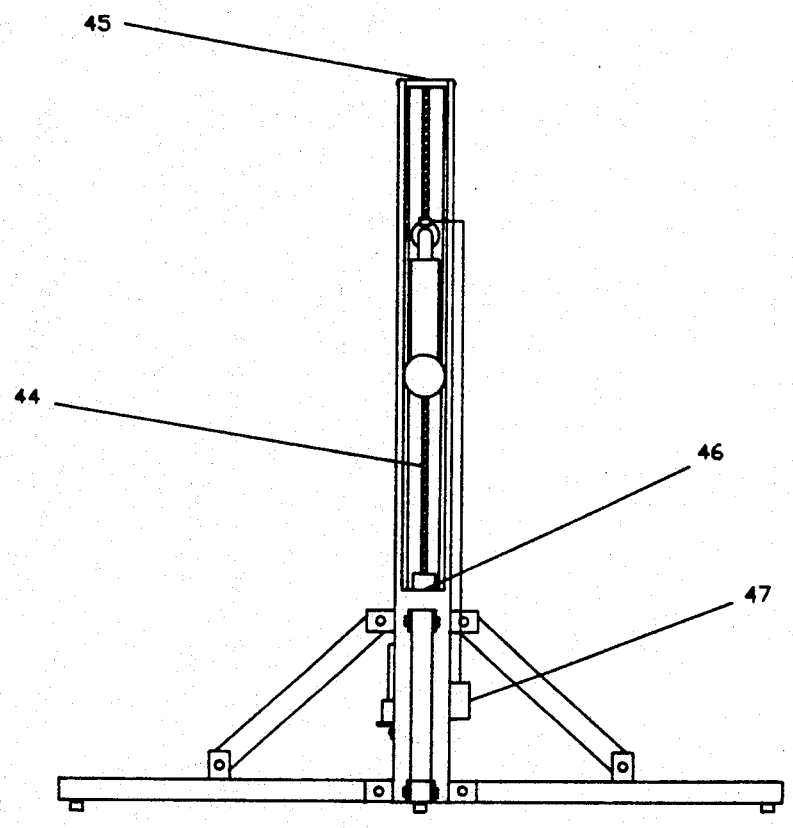
FIG. 2 shows a front view of the device in FIG. 1.

FIG. 2 shows the lead screw mechanism which includes a lead screw 44; an upper slide cap 45; a lead screw housing 46; a junction box 47. When the lead screw mechanism is activated by the control box shown in FIG. 4 the impact ball will move up and down through a simulated strike zone controlled by the limiting switches 60 and 61 as shown in FIG. 1. The strike zone is adjustable between 6 and 24 inches by manually fixing the distance between said limiting switches.

Figure 3:
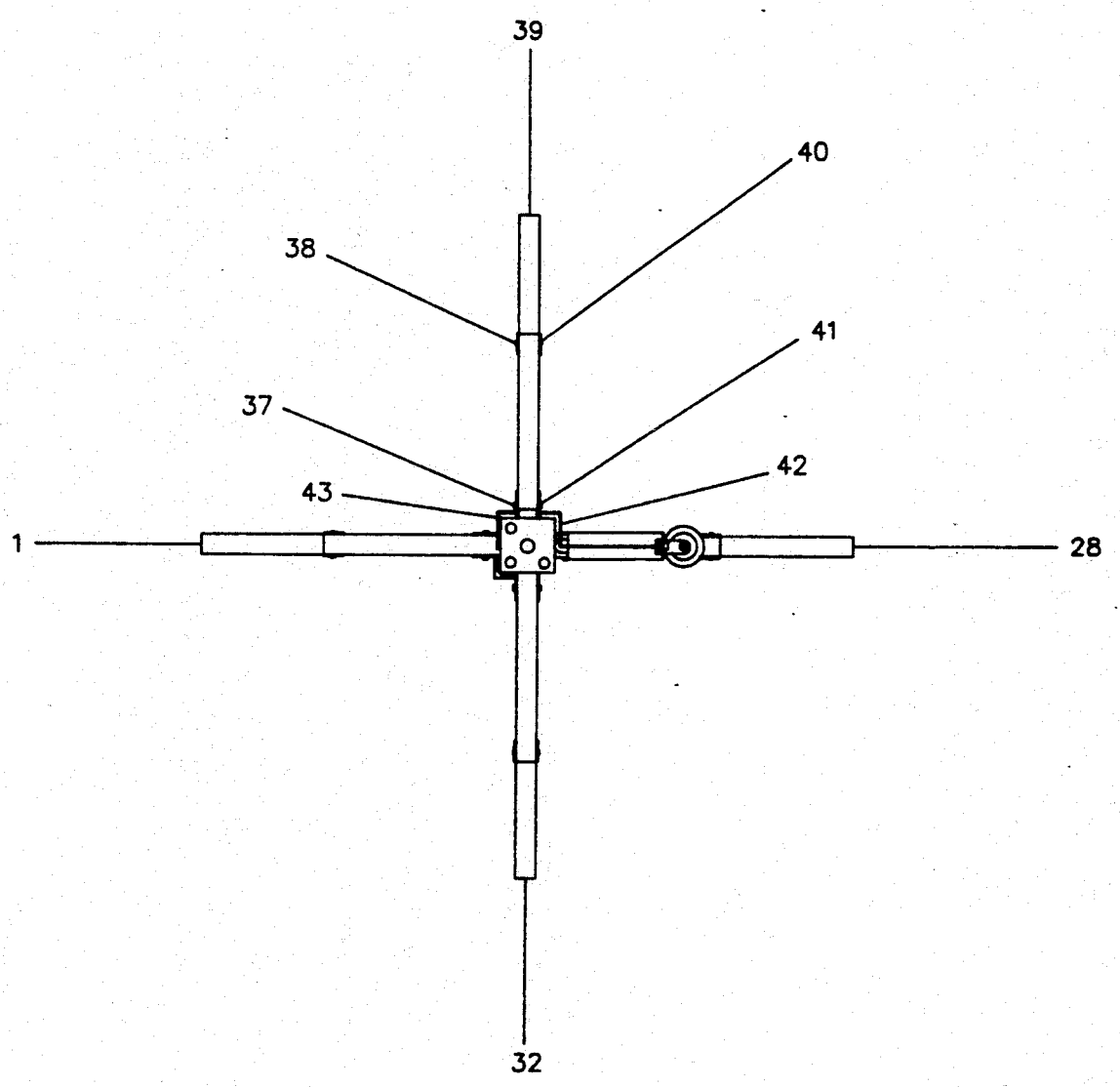
FIG. 3 shows a top view of the device in FIG. 1.

FIG. 3 is a top view showing the legs 1, 28, 32 and 39; microswitch wiring 42 and 43; leg brace attachment points or brackets 40 and 41; nuts and bolts 37 and 38 for attaching the leg brace to the legs and Frame 9 as shown in FIG. 1.

FIG. 4 is a front view of the control box showing the electronic controls and having a high intensity light 53; a multiple position switch 55; a digital display showing time in milliseconds 52; a fuse 54; an on/off switch 55; a power on/off indicator 56; cable clamps 57; a telescoping tripod 58. The high intensity light 53 as shown in FIG. 4 comes on at random times during the batting cycle which tells the batter when to strike at the ball. The ball stops when the light is illuminated and is controlled by the microprocessor. The on/off switch 55 connects power to the control box. When the impact ball is at either the top or bottom of the strike zone, the microprocessor reverses its direction automatically. When the impact ball reaches the lowest point of the strike zone, the microprocessor automatically reverses its direction. The LED readout 52 displays the time of the swing from the time the light 53 comes on to the time the ball is struck and is measured in milliseconds; although it can also be measured in time greater than one second. The electronic control box contains an electronic timer which activates the 12 or 24 volt DC motor through reversing relays. The motor will be energized for a period 2 to 8 seconds. During this time the ball will be moving through the strike zone. The period of time the motor is energized is random such that the batter will not know when or where the machine will stop within the strike zone. The electronic clock timer will start counting when the batting mechanism stops moving and the high intensity lamp 53 is energized. This time will then be displayed on the LED readout 52. A constant readout indicates that the reaction time from the light illuminating and the batter striking the ball is less than one second. A flashing LED indicates that the time is greater than one second by the values shown, such as one second plus two hundred and thirty five milliseconds. The control box allows approximately ten seconds per cycle and the device automatically resets; however, if the ball is not hit within ten seconds after a pitched ball indication from the high intensity lamp 53 coming on, the machine will reset itself to off so as not to use up battery power. The ball must be tapped to start the cycle when the batter is ready to start batting practice. The electronic box can be mounted upon a camera tripod 58 externally separate from the machine except for connecting electrical cables thereby protecting the device from shock and vibration and allowing the batter to place the control box in a convenient position simulating the position of an actual pitcher or pitched ball.

SUMMARY OF THE INVENTION

My invention enables a baseball player of any age, size, or stature, to improve his or her batting skills by taking as many or as few swings at the batting practice machines as their time, interest, and energy allows. The portable electromechanical device is battery powered, though any electrical source of 12 or 24 volts would do, and once activated, causes the urethane ball, mounted on a support arm to travel up and down through the strike zone. The movement through the strike zone is controlled by an electronic timing device that randomly activates an indicator light which tells the batter to swing at the urethane ball while at the same time briefly stopping the ball for the batter to swing at. Between the time the indicator light is activated and the urethane ball is struck by the batter, the timing device measures and records digitally the time elapsed to the nearest one-thousandth of a second, thereby giving the batter instant feedback as to the amount of time it took for him or her to initiate the swing and make contact with the ball. Depending on how close the batter stands to the urethane ball, the inside or outside of the strike zone can be simulated. After the urethane ball is struck and the pivot arm deflected, the device resets and once again the urethane ball begins to move up or down through the strike zone for another at bat. It can readily be seen that in a very brief time, a batter can take many swings thereby improving reaction time, hand/eye coordination, and improve the batter's physical strength. Additionally, a batting coach can readily observe the batter's stance and the batter's swing at the ball, the batter's power, the batter's control, the batter's reaction time, all over the course of as many swings as are convenient or necessary. The sensation to the batter following his or her swing in contact with the ball and the follow through as the ball pivots out of the way and the bat travels through, is strikingly similar to actual contact with an actual ball, the ball leaving the bat, and the bat follow through. The device is sturdily built and readily portable.

What is claimed is:

1. A device for baseball batting practice comprising;

a support frame; a ball affixed to one end of a flexible arm, said arm being rotatably attached at its other end to a frame member for rotation about an axis, such that when said ball is struck, said ball and said arm rotate freely about said axis;

said frame member being movably attached to said support frame, means for moving said frame member and ball upward and downward on said support frame through a distance approximately that of a baseball strike zone;

an electrical power source for energizing said means for moving said frame member and ball upward and downward on said support frame; and a control box having a light and means for computing the time of the batter's swing in milliseconds as measured from the time said light comes on and said ball is struck by a bat.

2. A device, according to claim 1, wherein said means for moving said frame member includes means for randomly starting and stopping said frame member substantially throughout said strike zone.

3. The device according to claim 1 wherein; said light is a high intensity lamp and said control box further include an automatic on/off switch, said means for controlling control movement of said ball through said strike zone over a range of 6 to 24 inches, and said means for computing further includes a light emitting diode read out for displaying elapse time between the time said high intensity lamp, representing a pitched ball, comes on and the time said ball is struck by a bat.

* * * * *